US007297068B2

(12) United States Patent
Costain et al.

(10) Patent No.: US 7,297,068 B2
(45) Date of Patent: Nov. 20, 2007

(54) VIBRATION DAMPING FOR A CUE STICK

(76) Inventors: Paul D. Costain, 2 Spruce Run, Beverly, MA (US) 01915; Bill Stroud, 8 Cir. Dr., Ruidoso Downs, NM (US) 88346

( * ) Notice: Subject to any disclaimer, the term of this patent is extended or adjusted under 35 U.S.C. 154(b) by 0 days.

(21) Appl. No.: 10/971,564

(22) Filed: Oct. 22, 2004

(65) Prior Publication Data

US 2006/0089203 A1 Apr. 27, 2006

(51) Int. Cl.
*A63D 15/08* (2006.01)

(52) U.S. Cl. ..... 473/44

(58) Field of Classification Search ..... 473/44–49; 280/602

See application file for complete search history.

(56) References Cited

U.S. PATENT DOCUMENTS

| | | | | |
|---|---|---|---|---|
| 248,681 | A | 10/1881 | Walter | |
| 682,677 | A | 9/1901 | Ferchland | |
| 965,131 | A | 7/1910 | Bliss | |
| 970,172 | A | 9/1910 | Bloom et al. | |
| 1,459,144 | A * | 6/1923 | Davneport et al. | 473/44 |
| 3,232,613 | A | 2/1966 | Laube, Jr. | |
| 3,436,079 | A | 4/1969 | Berry et al. | |
| 4,231,574 | A | 11/1980 | Williams | |
| 4,340,227 | A | 7/1982 | Dopkowski | |
| 4,565,392 | A | 1/1986 | Vyse | |
| 4,630,958 | A | 12/1986 | McCallister | |
| 4,645,245 | A | 2/1987 | Cunningham | |
| 4,816,203 | A | 3/1989 | Son-Kung | |
| 5,062,636 | A | 11/1991 | Rahn | |
| 5,112,046 | A | 5/1992 | Thorpe | |
| 5,334,101 | A | 8/1994 | McDermott | |
| 5,514,039 | A | 5/1996 | Gendron et al. | |
| 5,518,455 | A | 5/1996 | Costain et al. | |
| 5,527,224 | A | 6/1996 | Costain et al. | |

(Continued)

FOREIGN PATENT DOCUMENTS

| | | |
|---|---|---|
| CA | 726.578 | 1/1966 |

(Continued)

OTHER PUBLICATIONS

Wikipedia, "Piezoelectricity", Dec. 15, 2003, 3 pages.*

(Continued)

*Primary Examiner*—Mark S Graham
(74) *Attorney, Agent, or Firm*—Hamilton, Brook, Smith & Reynolds, P.C.

(57) ABSTRACT

In an embodiment of the invention, a vibration damping shaft of a cue stick comprises a shaft that is configured to form an axially rigid ensemble by mating with another segment of a cue stick. The shaft includes damping material that reduces the vibration of the shaft when a ball strikes the shaft. The damping material may have a density greater than wood. The damping material may be configured as an annular region in the shaft, or in any other configuration that reduces shaft vibration. Damping materials include composites, such as piezoelectric materials, with fibers that are generally aligned to reduce shaft vibration. Another embodiment of the invention utilizes a universal shaft insert, allowing the shaft to fit another segment of a cue stick having a particular joint pin configuration. Features of the a vibration damping shaft may also be incorporated into a cue stick that is not collapsible.

5 Claims, 4 Drawing Sheets

U.S. PATENT DOCUMENTS

| | | | | | |
|---|---|---|---|---|---|
| 5,749,788 | A | * | 5/1998 | Bourque | 473/44 |
| 5,827,797 | A | | 10/1998 | Cass et al. | |
| 5,869,189 | A | | 2/1999 | Hagood, IV et al. | |
| 5,890,966 | A | | 4/1999 | Costain et al. | |
| 5,927,894 | A | | 7/1999 | Zavaglia | |
| 6,027,410 | A | | 2/2000 | Costain et al. | |
| 6,048,622 | A | | 4/2000 | Hagood, IV et al. | |
| 6,086,490 | A | * | 7/2000 | Spangler et al. | 473/564 |
| 6,102,426 | A | * | 8/2000 | Lazarus et al. | 280/602 |
| 6,110,051 | A | | 8/2000 | McCarty et al. | |
| 6,132,321 | A | | 10/2000 | Wethered | |
| 6,227,980 | B1 | | 5/2001 | Costain et al. | |
| 6,348,006 | B2 | | 2/2002 | Costain et al. | |
| 6,395,080 | B1 | | 5/2002 | Cass et al. | |
| 6,398,660 | B1 | | 6/2002 | Probst et al. | |
| 6,620,287 | B2 | | 9/2003 | Cass | |
| 6,712,712 | B2 | | 3/2004 | Bourque | |
| 6,736,733 | B2 | | 5/2004 | Yu | |
| 2002/0082098 | A1 | * | 6/2002 | Lai Chuang | 473/44 |
| 2003/0153393 | A1 | * | 8/2003 | Chang | 473/44 |
| 2004/0009822 | A1 | | 1/2004 | McCarty | |
| 2004/0152544 | A1 | * | 8/2004 | Lammer | 473/520 |

FOREIGN PATENT DOCUMENTS

| | | | | |
|---|---|---|---|---|
| CA | 726578 | | * | 1/1966 |
| GB | 8849 | A | | 7/1885 |
| GB | 2191707 | A | | 12/1987 |
| GB | 2192800 | A | | 1/1988 |
| GB | 2199505 | A | | 7/1988 |
| GB | 2219515 | A | * | 12/1989 |
| GB | 2219946 | A | | 12/1989 |
| GB | 2226251 | A | | 6/1990 |
| GB | 2246302 | A | | 1/1992 |

OTHER PUBLICATIONS

Drawing of coupling rod manufactured by Bender Cues for securing to one stick portion of a cue stick (Jul. 13, 1992).

Drawing of a prior art cue stick portion having a coupling rod and joint collar (at least by 1985).

Drawing depicting a coupling joint which engages in three revolutions. The smooth elongate tip extending from the external threaded region is not in a close fit with the bore extending from the internal threaded region upon engaging the two threaded regions.

Drawing depicting a coupling joint which has an external threaded region characterized by a significant number of threads. The internal threaded region is characterized by the two threads. Extending from the internal threaded region is a smooth bore for receiving the external threaded region. The coupling joint engages in a significant number of revolutions.

* cited by examiner

VIBRATION DAMPING FOR A CUE STICK

BACKGROUND OF THE INVENTION

Cue sticks for pool and billiards game play are typically constructed to efficiently transmit momentum from the cue to a ball being struck. Cue sticks oftentimes are constructed of wood, which possesses particular properties that affect the way forces are transmitted to the hand of a player.

SUMMARY OF THE INVENTION

In instances where a player attempts to impart spin on the cue ball (i.e., english) to direct a particular type of shot, the free end of a cue stick strikes the ball in a line that does not travel through the center of mass of the ball. As a result, substantial force may be generated in a direction orthogonal to the axis of the cue stick. In particular, the shaft of the cue stick, being thinner and more flexible than the butt, is subject to substantial vibration, which may affect the trajectory of the cue ball. Thus, players must correct for this phenomena when imparting english to their shots. Therefore, a need exists for a cue stick, or shaft of a cue stick, that is less subject to vibration, which may reduce need for players to correct deflection associated with a shot having english.

Simultaneously, players desire a cue stick that is stiff such that the efficient transmission of momentum from cue stick to ball is maintained when a shot is performed. As well, players often favor a cue stick which has the weight distribution, and transmits forces to the hand of a player in the manner of, a wooden cue. Though cues made of materials other than wood exist, such cues lack many of the properties of wooden cues that players desire. In particular, many materials tend to accentuate the vibration of a cue stick. Use of such materials may substantially alter the trajectory of a shot when the material is incorporated near the ball strike end of the stick. Use of light, non-structural materials (e.g., cotton) may occupy a large relative volume of the cue stick to achieve sufficient vibration damping. Such a loss of volume of structural material may substantially affect the "feel" of such cue sticks when a ball is struck.

In some embodiments of the invention, a vibration reducing shaft for a cue stick includes a shaft configured to form an axially rigid ensemble when mated with another segment of the cue stick. The shaft includes a damping material with a density higher than wood; the damping material may also be a piezoelectric material without regard to its density. The damping material is configured to reduce the vibration of the shaft when a ball strikes the free end of the shaft. Thus, the damping material may provide substantial vibration reduction without occupying a large relative volume of the shaft such that the force transmission properties of the shaft are adversely affected.

The shaft may be configured to detachably receive another segment of the cue stick. Damping materials that may be used with the vibration reducing shaft include composites, including composites with fibers or some type of cellular structure. The fibers may be substantially aligned in a particular direction (e.g., parallel the longitudinal axis of the shaft). Piezoelectric materials, with and without aligned fibers, may be utilized. The damping material may be located in the butt end of a shaft or within the half of a shaft away from the free end. The damping material may be configured as an annular region of the shaft, or as a cored section in the shaft.

The damping materials previously described may also be used in a vibration reducing cue stick without regard to whether the damping material is used within a shaft.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
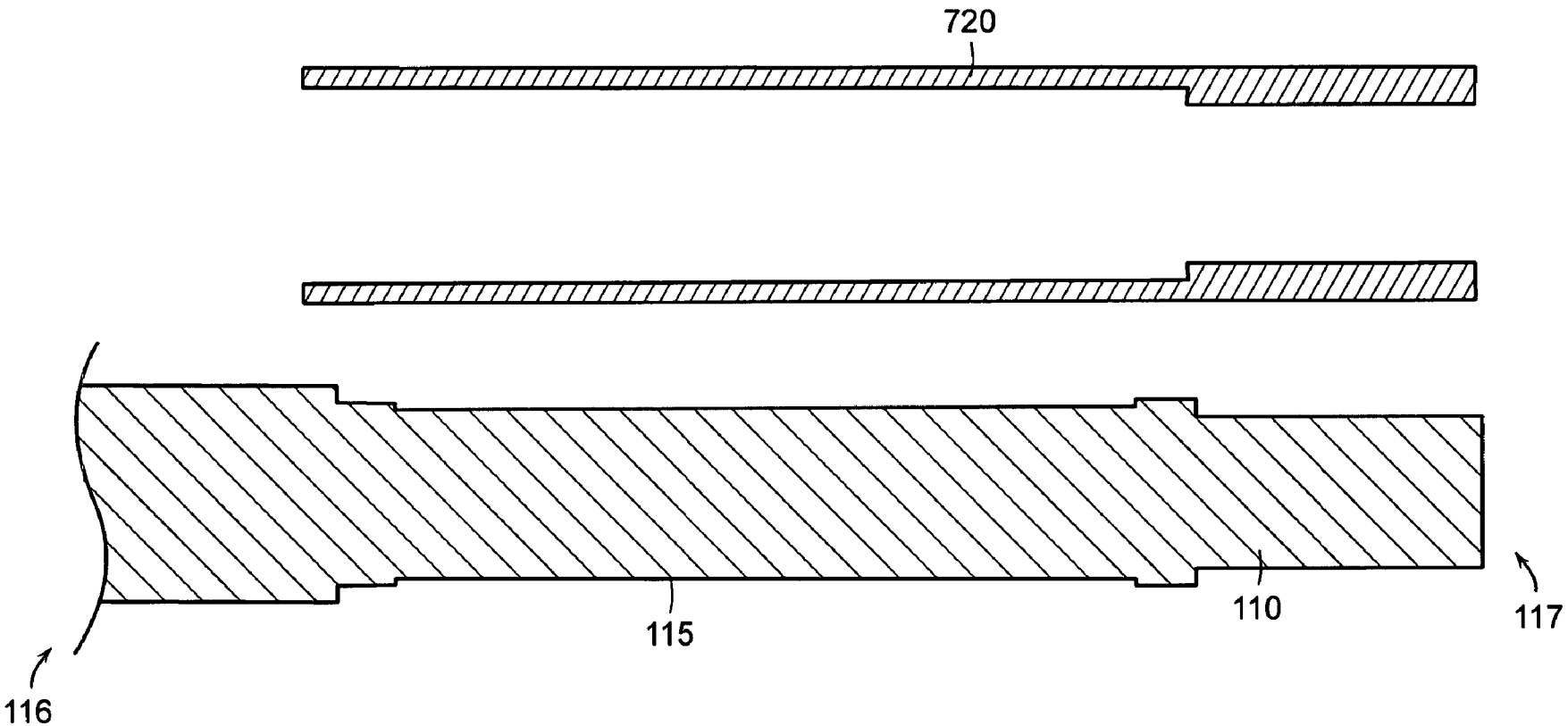
FIG. 1 is a cross sectional side view of component pieces of a shaft that may utilize damping material, in accordance with an embodiment of the invention.
Figure 2:
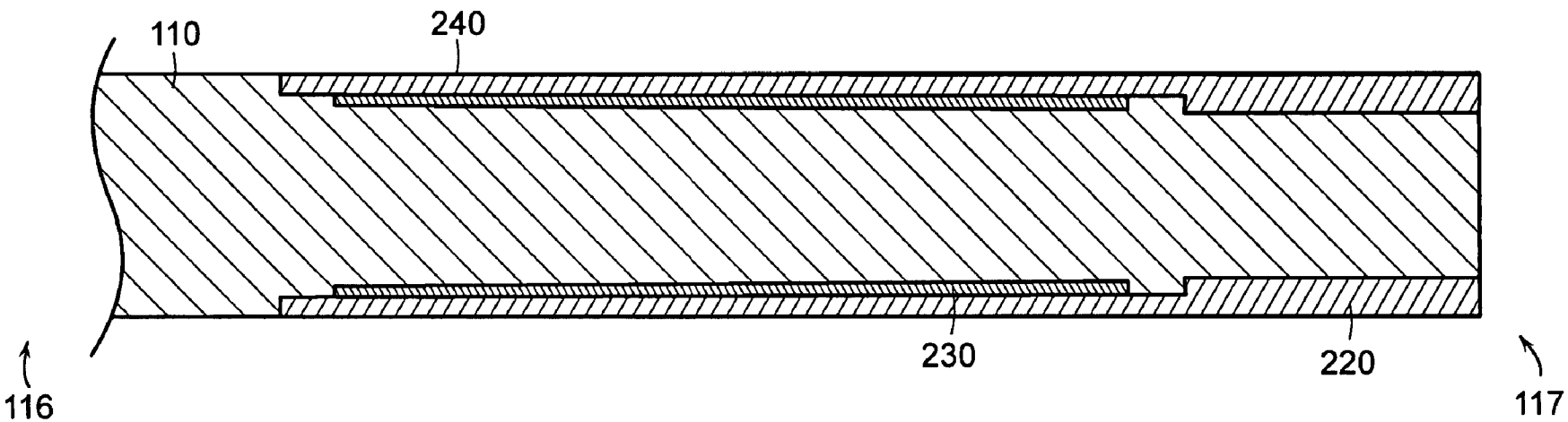
FIG. 2 is a cross sectional side view of an assembled shaft from the component pieces of FIG. 1 and damping material, in accordance with an embodiment of the invention.

FIG. 1 depicts pieces that may be utilized to form a vibration reducing shaft, in accordance with an embodiment of the invention. A shaft body 110 has a free end side 116 and a butt end side 117. A portion of the body 110 is configured to receive a sleeve 120. When the sleeve 120 is fitted over the body 110, as shown in FIG. 2, the combination has a substantially smooth outer surface 240. The shaft body 110 is also configured with a circumferentially formed sunken tier 115 around the shaft body 110. The sunken tier 115 forms an annular region when the sleeve 120 is combined with the shaft body 110. A damping material 230 is placed in the annular region. The damping material 230 reduces the vibration of the shaft in the radial direction when the free end 116 of the shaft strikes a ball.

The shaft body 110 is typically constructed of wood, though shaft bodies constructed with other materials are also within the scope of the invention. Likewise, the sleeve 120 may be made from a variety of materials, but is advantageously constructed from wood impregnated with epoxy, phenolic, or other composite materials that are readily engineered into precise configurations without being subject to changes in humidity or other environmental conditions.

Figure 3:
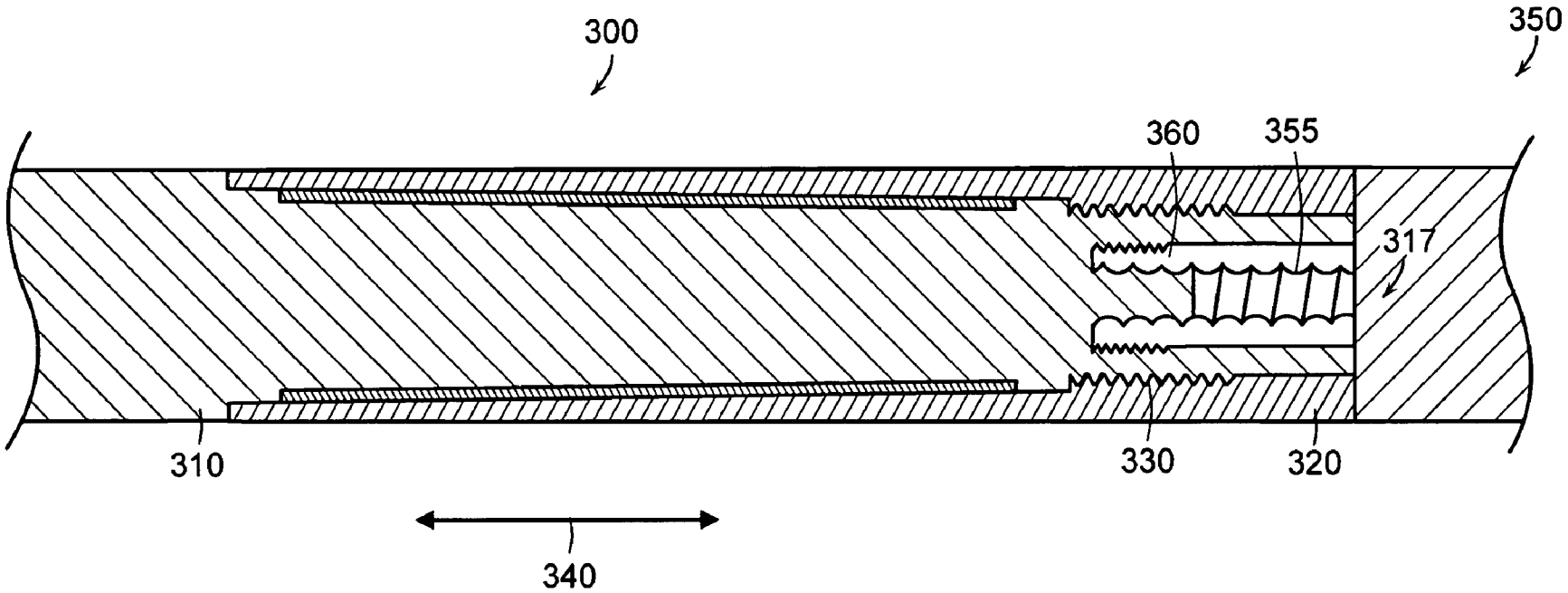
FIG. 3 is a cross sectional side view of a shaft with damping material attached to a butt of a cue stick using a ball screw threaded pin and the corresponding pin insert, in accordance with an embodiment of the invention.

The damping material 230 may be a sheet which is configured to be wrapped around the shaft body 110 in the sunken tier region 115. The sleeve 120 may be subsequently slipped over the butt end 117 of the shaft body 110 to hold the damping material 230 in place. Typically the damping material 230, sleeve 120, and shaft body 110 are bonded together with adhesive, or using some other technique known in the art. FIG. 3 shows an alternative embodiment of the invention in which the sleeve 320 and shaft body 310 have a complementary thread configuration 330 such that the sleeve 320 may be screwed onto the body 310.

Vibration reducing shafts may utilize a joint system to detachably receive a cue stick butt or other segment of a cue stick. For example, as depicted in FIG. 3, the butt end 317 of a shaft may have an embedded insert 360. The insert 360 is configured to detachably mate the pin 355 of a cue stick butt segment 350. The mated shaft and butt form an axially rigid ensemble that is stiff, and has minimal flex in the axial direction 340. The axial stiffness allows the vibration reducing shaft to maintain efficient transmission of momentum axially when the stick strikes a ball. Alternatively, the vibration reducing shaft may be bonded to the butt to form a cue stick that is not collapsible.

Various types of materials, such as plastics or composites of materials including various types of fillers, may be utilized as a damping material in embodiments of the invention. For example, ceramic fibers (e.g., as described by Cass et al. in U.S. Pat. No. 5,827,797 and related applications) may be embedded in a matrix, such as a polymer based substance, to form a passive piezoelectric material that acts as the damping material. In another example, piezoelectric fibers (e.g., as described by Hagood, IV et al. in U.S. Pat. No. 5,869,189 and related applications) may be incorporated into a matrix, forming a damping material that can harvest vibrational energy actively to actuate further vibration damping of the material in a particular direction (e.g., as described by Cass in U.S. Pat. No. 6,620,287).

The fibers utilized in a damping material may have a general orientation (i.e., the fibers tend to align in a particular direction) such that the vibration reducing quality of the material has a directional component. In a preferred embodiment of the invention, the filaments in a damping material incorporated into a portion of a cue stick may be substantially aligned parallel to the longitudinal axis of the cue 340. Such an orientation may improve the stiffness of a cue stick in the radial direction, and thus decrease vibration.

Other types of composite materials, beyond piezoelectric materials, that utilize fibers or other fillers, such as a cellular structure (e.g., a honeycomb structure), may also be utilized as a damping material.

Some damping materials, such as the piezoelectric materials described above, have superior vibration reduction properties relative to non-structural materials such as foams, cotton, and other materials with a density lower than the shaft body (e.g., wood). Thus, such damping materials can provide a substantial amount of vibration reduction without occupying a substantial volume of the cue stick, and potentially adversely affecting the force transmission properties of the shaft desired by billiards players.

As utilized in FIGS. 2 and 3, the damping material is located in the butt end of the shaft, away from the free end which is used the strike a cue ball. This may be particularly advantageous since the effects of altered shaft deflection during an off-ball-center shot may be decreased. For example, when damping materials having a density greater than wood (e.g., some of the piezoelectric materials previously described) are utilized adjacent to the ferrule of a cue stick, the mechanical properties of the shaft may adversely affect players since such properties differ substantially from conventional materials such as wood. By incorporating the damping material in the butt end of the shaft, or within the half of the shaft closest to the butt end, substantial vibration reduction may be realized without substantial adverse effects on shaft deflection.

Though the shafts depicted in FIGS. 1-3 utilize a damping material configured as an annulus in the shaft of a cue stick, embodiments of the invention do not require that a damping material be configured as an annulus. The damping material may be configured in any manner that reduces the vibration of the cue stick when a ball is struck. For example, the damping material may constitute one or more cored sections of material axially aligned with the shaft of a cue stick.

Furthermore, though use of damping material has been described in the context of shafts of cue sticks in various embodiments of the invention, the features of these embodiments may be incorporated into a cue stick which is not collapsible or formed from multiple pieces. The damping material may also be incorporated into other portions of a cue stick besides the shaft to enhance the vibration reducing characteristics of such portions. For example, a cored section of damping material may be incorporated into the handle of a cue stick to prevent excess vibration of that portion of the stick.

In another embodiment of the invention, a universal shaft fitting is utilized in conjunction with a vibration reducing shaft having a damping material to allow the shaft to fit with a cue stick segment having a particular pin configuration. A description of the aspects of a vibration reducing shaft are found in a U.S. patent application Ser. No. 10/972,087 entitled "UNIVERSAL FITTING FOR A CUE STICK," and having the same inventors and the same filing date as the present application. The entire teachings of the U.S. patent application are hereby incorporated herein by reference in their entirety.

Figure 4:
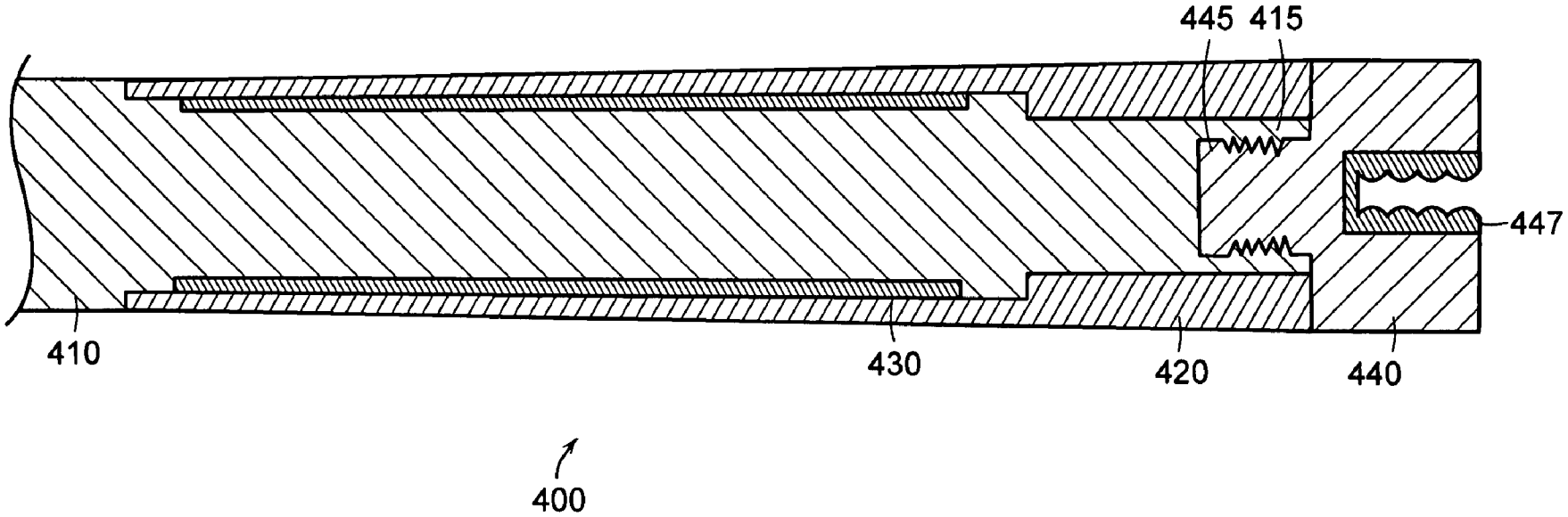
FIG. 4 is a cross sectional side view of a portion of a vibration reducing shaft that incorporates a universal shaft fitting, the universal shaft fitting including a universal adapter and an insert, in accordance with an embodiment of the invention.

FIG. 4 depicts a cross sectional view of a vibration reducing shaft consistent with an embodiment of the invention that incorporates the use of a universal shaft fitting. The vibration reducing shaft 400 includes a shaft 410 with a damping material 430 configured to reduce the vibration of the shaft when a ball strikes the end of the shaft. In the particular embodiment shown in FIG. 4, the damping material 430 is wrapped around the shaft 410 to form an annular region. A sleeve 420 is positioned over the shaft 410 and damping material 430. The vibration reducing shaft also includes a universal shaft fitting comprising a universal adapter 440 and an insert 447. The universal adapter has an extension 445 with external threads bonded into a butt end 415 of the shaft 410. The universal adapter 440 is also mated and bonded to the insert 447. The insert 447 has internal threads configured to detachably receive an externally threaded pin of a segment of a cue stick. The combination of the vibration reducing shaft and segment may form an axially rigid body.

Other related embodiments of the invention combine various features of embodiments of a vibration reducing shaft, or cue stick, with features of a universal shaft fitting as revealed and incorporated herein. These are all within the scope of the present invention.

While this invention has been particularly shown and described with references to preferred embodiments thereof, it will be understood by those skilled in the art that various changes in form and details may be made therein without departing from the scope of the invention encompassed by the appended claims.

What is claimed is:

1. A vibration reducing shaft for a cue stick comprising:

a shaft with a free end and a butt end, the shaft comprising a wood material and configured to form an axially rigid ensemble by mating with a segment portion of the cue stick, the shaft including a damping material, the damping material having a density greater than the wood material of the shaft, the damping material configured to reduce the vibration of the shaft when a ball strikes the free end of the shaft; the damping material being located within a half of the shaft closest to the butt end; the damping material comprising a composite material that includes a piezoelectric material with fibers substantially aligned along a longitudinal direction of the shaft.

2. A vibration reducing shaft according to claim 1, wherein the shaft is configured to detachably receive the segment portion of the cue stick.

3. A vibration reducing shaft according to claim 1, wherein the composite material includes a cellular structure.

4. A vibration reducing shaft according to claim 1, wherein the damping material is further configured to form an annular region of the shaft.

5. A vibration reducing shaft according to claim 1, wherein the damping material is further configured to form a cored section in the shaft.

* * * * *